US010217411B2

(12) United States Patent
Shang

(10) Patent No.: US 10,217,411 B2
(45) Date of Patent: Feb. 26, 2019

(54) DISPLAY DRIVING CIRCUIT, DRIVING METHOD THEREOF AND DISPLAY APPARATUS

(71) Applicant: BOE TECHNOLOGY GROUP CO., LTD., Beijing (CN)

(72) Inventor: Guangliang Shang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 410 days.

(21) Appl. No.: 14/785,953

(22) PCT Filed: Nov. 21, 2014

(86) PCT No.: PCT/CN2014/091830
§ 371 (c)(1),
(2) Date: Oct. 21, 2015

(87) PCT Pub. No.: WO2016/008248
PCT Pub. Date: Jan. 21, 2016

(65) Prior Publication Data

US 2016/0155386 A1 Jun. 2, 2016

(30) Foreign Application Priority Data

Jul. 18, 2014 (CN) ..... 2014 1 0342889

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0842* (2013.01);
(Continued)

(58) Field of Classification Search
CPC ..... G09G 3/3258; G09G 3/3233; G09G 2300/0842; G09G 2300/0866;
(Continued)

(56) References Cited

U.S. PATENT DOCUMENTS 5,490,005 A * 2/1996 Jueliger ..... G09G 3/3406 349/116
7,064,733 B2 6/2006 Cok et al.
(Continued)

FOREIGN PATENT DOCUMENTS

CN 1347074 A 5/2002
CN 1808548 A 7/2006
(Continued)

OTHER PUBLICATIONS

International Search Report of PCT/CN2014/091830 in Chinese, dated Apr. 27, 2015 with English translation.
(Continued)

*Primary Examiner* — Stephen G Sherman
(74) *Attorney, Agent, or Firm* — Collard & Roe, P.C.

(57) ABSTRACT

Disclosed are a display driving circuit and a driving method thereof, and a display apparatus. The display driving circuit comprises a control unit (13), a light emitting device (20) and a collection unit (21). The collection unit (21) is connected with one terminal of the light emitting device (20), the control unit (13) and a collection signal input terminal (Fn) respectively, and is configured to collect brightness of the light emitting device (20) according to a signal input from the collection signal input terminal (Fn) and feed a collection result to the control unit (13); the control unit (13) is connected with the one terminal of the light emitting device (20) and the collection unit (21) respectively, and is configured to adjust an actual light emitting brightness value (L) of the light emitting device
(Continued)

(20) to a target brightness value (D) according to the collection result; and the other terminal of the light emitting device (20) is connected with a first voltage (VSS), and is configured to emit light under the control of the control unit (13). The display driving circuit can bring uniformity of brightness in light emitted from respective pixel units.

19 Claims, 5 Drawing Sheets

(52) U.S. Cl.
CPC ..... *G09G 2300/0866* (2013.01); *G09G 2320/029* (2013.01); *G09G 2320/0233* (2013.01); *G09G 2320/043* (2013.01); *G09G 2320/0626* (2013.01); *G09G 2330/028* (2013.01); *G09G 2360/148* (2013.01)

(58) Field of Classification Search
CPC ..... G09G 2320/043; G09G 2320/029; G09G 2320/0233; G09G 2320/0626; G09G 2330/028; G09G 2360/14–2360/148; G09G 3/0412; G09G 3/3659; G09G 3/042; G09G 3/041; G09G 3/3225; G09G 2354/00; G09G 2320/045
See application file for complete search history.

(56) References Cited

U.S. PATENT DOCUMENTS

| | | | | |
|---|---|---|---|---|
| 8,405,579 | B2 | 3/2013 | Choi et al. | |
| 8,941,697 | B2 | 1/2015 | Nathan et al. | |
| 2006/0256048 | A1 | 11/2006 | Fish et al. | |
| 2007/0115685 | A1 | 5/2007 | Kondo et al. | |
| 2009/0243498 | A1* | 10/2009 | Childs | G09G 3/3233 315/169.3 |
| 2009/0316381 | A1 | 12/2009 | Kurt | |
| 2010/0149079 | A1 | 6/2010 | Yamashita et al. | |
| 2011/0074753 | A1 | 3/2011 | Yamamoto et al. | |
| 2011/0164010 | A1 | 7/2011 | Yamamoto et al. | |
| 2011/0304599 | A1 | 12/2011 | Yasui | |
| 2014/0125643 | A1 | 5/2014 | Kuo et al. | |
| 2015/0145424 | A1* | 5/2015 | Zhang | G02F 1/133603 315/185 R |

FOREIGN PATENT DOCUMENTS

| | | | |
|---|---|---|---|
| CN | 1846243 | A | 10/2006 |
| CN | 1875395 | A | 12/2006 |
| CN | 1971367 | A | 5/2007 |
| CN | 101084537 | A | 12/2007 |
| CN | 101159121 | A | 4/2008 |
| CN | 101751846 | A | 6/2010 |
| CN | 101976679 | A | 2/2011 |
| CN | 102034427 | A | 4/2011 |
| CN | 102074179 | A | 5/2011 |
| CN | 102122486 | A | 7/2011 |
| CN | 103268755 | A | 8/2013 |
| CN | 104157237 | A | 11/2014 |

OTHER PUBLICATIONS

Notice of Transmittal of the International Search Report of PCT/CN2014/091830 in Chinese, dated Apr. 27, 2015.
Nritten Opinion of the International Searching Authority of PCT/CN2014/091830 in Chinese, dated Apr. 27, 2015 with English translation.
Chinese Office Action in Chinese Application No. 201410342889.1 dated Dec. 1, 2015 with English translation.

* cited by examiner

DISPLAY DRIVING CIRCUIT, DRIVING METHOD THEREOF AND DISPLAY APPARATUS

CROSS REFERENCE TO RELATED APPLICATIONS

This application is the National Stage of PCT/CN2014/091830 filed on Nov. 21, 2014, which claims priority under 35 U.S.C. § 119 of Chinese Application No. 201410342889.1 filed on Jul. 18, 2014, the disclosure of which is incorporated by reference.

TECHNICAL FIELD

The present disclosure relates to a display driving circuit, a driving method thereof and a display apparatus.

BACKGROUND

With the rapid development of the display technology, the technology of semiconductor components, which is a core of the display apparatus, has experienced a great progress. For a known display apparatus composed of Organic Light Emitting Diode (OLED) devices (referred to as the OLED display apparatus briefly thereafter), which is characterized by its features such as self-illumination, fast response, wide viewing angle, and capable of being fabricated on a flexible substrate and so on, it is increasingly applied in the field of high performance display.

Because a control unit in the general OLED display apparatus includes transistors, threshold voltages Vth of the transistors are different among the different pixel units, and the Vth in the same pixel may drift over time, which may cause difference in the display brightness. Therefore, a method of compensating the threshold voltage Vth is usually used to make currents flowing through the OLED devices to be identical with each other. However, there are also some differences in a light emitting efficiency of the OLED devices in the different pixel units, such that it also can not solve completely a problem of the non-uniform brightness in the light emitted from the respective pixel units even if the currents that drive the OLED devices are the same.

SUMMARY

At least one embodiment of the present disclosure provides a display driving circuit, a driving method thereof and a display apparatus, which can bring uniformity of brightness in light emitted from respective pixel units.

According to an aspect of the embodiments of the present disclosure, there is provided a display driving circuit comprising a control unit, a light emitting device and a collection unit;

the collection unit is connected with one terminal of the light emitting device, the control unit and a collection signal input terminal respectively, and is configured to collect brightness of the light emitting device according to a signal input from the collection signal input terminal and feed a collection result to the control unit;

the control unit is connected with the one terminal of the light emitting device and the collection unit respectively, and is configured to adjust an actual light emitting brightness value of the light emitting device to a target brightness value according to the collection result;

the other terminal of the light emitting device is connected with a first voltage, and the light emitting device is configured to emit light under the control of the control unit.

According to another aspect of the embodiments of the present disclosure, there is provided a display apparatus comprising an anode, a cathode and an organic material functional layer located between the anode and the cathode, and further comprising any one of the display driving circuits described above; wherein the control unit and the collection unit of the display driving circuit are disposed on a surface of the anode at a side far away the organic material functional layer;

at least the anode corresponding to a position at which the collection unit is disposed is made up of a transparent conductive material.

According to a further aspect of the embodiments of the present disclosure, there is provided a driving method of a display driving circuit, comprising:

collecting, by a collection unit, brightness of a light emitting device, and feeding a collection result to a control unit;

controlling, by the control unit, to adjust an actual light emitting brightness value of the light emitting device to a target brightness value according to the collection result; and emitting light, by the light emitting device, under the control of the control unit.

The embodiments of the present disclosure provide a display driving circuit, a driving method thereof and a display apparatus. The display driving circuit comprises a control unit, a light emitting device and a collection unit. The collection unit is configured to collect a brightness of the light emitting device and feed a collection result to the control unit, the control unit is configured to adjust an actual light emitting brightness value of the light emitting device to a target brightness value according to the collection result, and the light emitting device is configured to emit light under the control of the control unit. As such, the display driving circuit can collect the light emitting brightness of the light emitting device and adjust the brightness of the light emitting device in real-time according to the above collection result, thus the actual light emitting brightness of the light emitting device can reach the target brightness value, which can ensure uniformity of brightness in light emitted from respective pixel units.

BRIEF DESCRIPTION OF THE DRAWINGS

In order to explain solutions in embodiments of the present disclosure or known solutions more clearly, drawings required for describing the embodiments of the present disclosure or the known solutions will be introduced briefly below. Obviously, the drawings described below are only some embodiments of the present disclosure, but those ordinary skilled in the art may obtain other drawings according to these drawings without any inventive labors. Wherein.

DETAILED DESCRIPTION

Figure 1A:
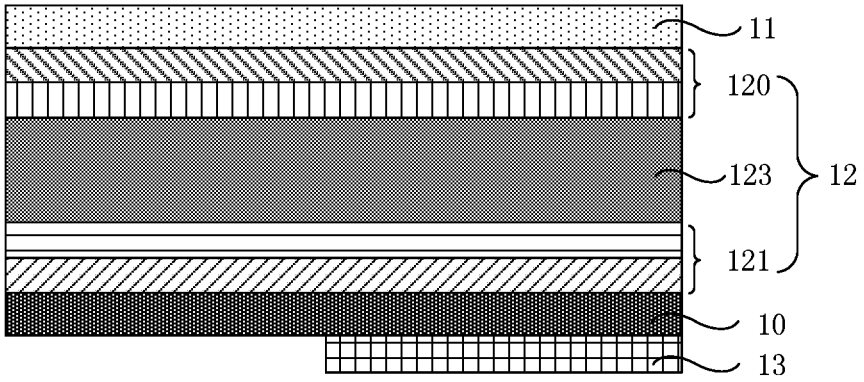
Fig. 1a (Prior Art)
FIG. 1*a* is an exemplary view illustrating a structure of a general OLED display apparatus.

FIG. 1*a* is an exemplary view illustrating a structure of a general OLED display apparatus. A light emitting module in this OLED display apparatus comprises an anode 10 and a cathode 11 configured to be applied a voltage, an organic material functional layer 12 located between the anode 10 and the cathode 11, and a control unit 13 disposed at one side of the anode 10, as illustrated in FIG. 1*a*. A light emitting principle of the OLED display apparatus is as follows: under an effect of an electric field applied externally, an electron layer 120 and a hole layer 121 are injected into an organic light emitting material layer 123 from a positive electrode and a negative electrode respectively, and in turn move, recombine and attenuate in the organic light emitting material layer 123, thus the light is emitted.

Figure 1B:
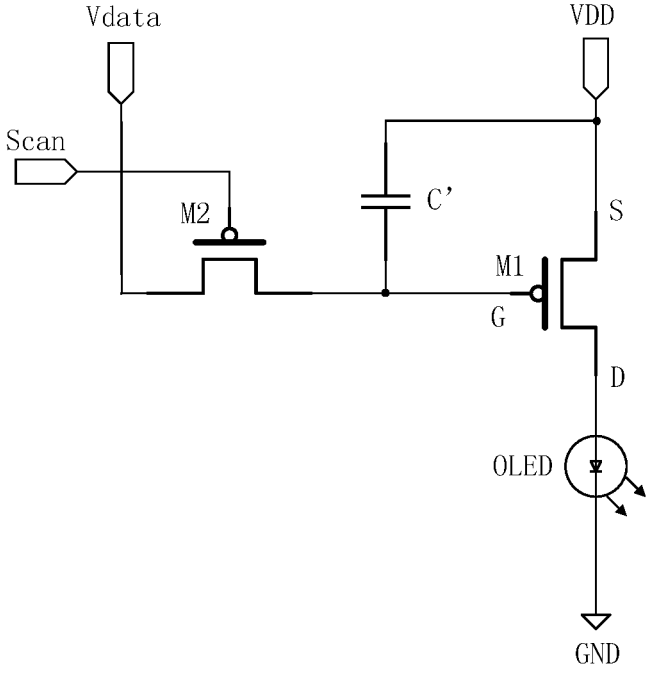
Fig. 1b (Prior Art)
FIG. 1*b* is an exemplary view illustrating a structure of a general control unit.

A detailed structure of the control unit 13 is as illustrated in FIG. 1*b*, wherein the control unit 13 comprises transistors M1, M2, a capacitor C' and an OLED device. A source (S) of the transistor M1 is connected with a voltage VDD, one terminal of the OLED device is connected with a drain (D) of the M1, and the other terminal of the OLED device is grounded. For example, in a light emitting phase, a scan signal Scan inputs an ON signal, the transistor M2 is turned on; a data line inputs a data signal Vdata, the transistor M1 is turned on. As such, a current flowing through the transistor M1 drives the OLED device to emit light. According to a current characteristic of a TFT in a saturation area, the current flowing through the transistor M1 is obtained as:

$$Ids=\frac{1}{2}\times K\times(Vgs-Vth)^2;$$

wherein K is a current constant associated with the transistor M1; Vgs is a voltage of a gate (G) of the transistor M1 with respect to the source (S) of the transistor M1, and Vth is a threshold voltage of the transistor M1.

Because the threshold voltages Vths of the transistors M1 are different among different pixel units and the Vth in a same pixel unit may drift over time, differences in display brightness would occur.

Solutions of the embodiments of the present disclosure would be described clearly and completely in connection with drawings of the embodiments of the present disclosure.

Figure 2:
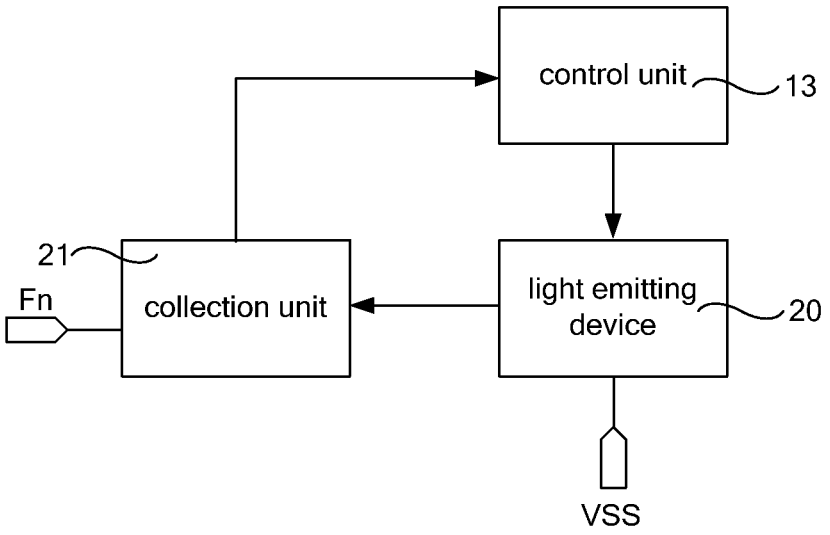
FIG. 2 is an exemplary view illustrating a structure of a display driving circuit provided by an embodiment of the present disclosure.

FIG. 2 is an exemplary view illustrating a structure of a display driving circuit provided by an embodiment of the present disclosure. As illustrated in FIG. 2, the display driving circuit comprises a control unit 13, a light emitting device 20 and a collection unit 21.

The collection unit 21 is connected with one terminal of the light emitting device 20, the control unit 13 and a collection signal input terminal Fn respectively, and is configured to collect brightness of the light emitting device 20 according to a signal input from the collection signal input terminal Fn and feed a collection result to the control unit 13.

The control unit 13 is connected with the one terminal of the light emitting device 20 and the collection unit 21 respectively, and is configured to adjust an actual light emitting brightness value L of the light emitting device 20 to a target brightness value D according to the collection result.

The other terminal of the light emitting device 20 is connected with a first voltage VSS, and the light emitting device is configured to emit light under the control of the control unit 13.

The following should be noted.

First, the above actual light emitting brightness value L is a light emitting brightness value of the light emitting device 20 under a brightness adjustment by the control unit 13. The target brightness value D may be a preset value which is a reference standard for adjustment of the light emitted from the light emitting device 20. The control unit 13 aims to adjust the actual light emitting brightness value of the light emitted from the light emitting device 20 to the above reference standard, so that the brightness values in the entire display panel are uniform.

Second, the above light emitting device 20 may be various general current-driven types of light emitting devices including a Light Emitting Diode (referred to as LED briefly) or an Organic Light Emitting Diode (referred to as OLED briefly). In the embodiments of the present disclosure, the description is made by taking the OLED device as an example. When the light emitting device is the OLED, the anode of the OLED device is connected with the collection unit 21 and the cathode of the OLED device is connected with the first voltage VSS.

The embodiments of the present disclosure provide the display driving circuit, and the display driving circuit comprises the control unit, the light emitting device and the collection unit. The collection unit is configured to collect the brightness of the light emitting device and feed the collection result to the control unit, the control unit is configured to control to adjust the actual light emitting brightness value of the light emitting device to the target brightness value according to the collection result, and the light emitting device is configured to emit light under the control of the control unit. As such, the display driving circuit can collect the light emitting brightness of the light emitting device and adjust the brightness of the light emitting device in real-time according to the above collection result, thus the actual light emitting brightness of the light emitting device can reach the target brightness value finally, which can make the brightness of light emitted from respective pixel units be uniform.

Figure 3:
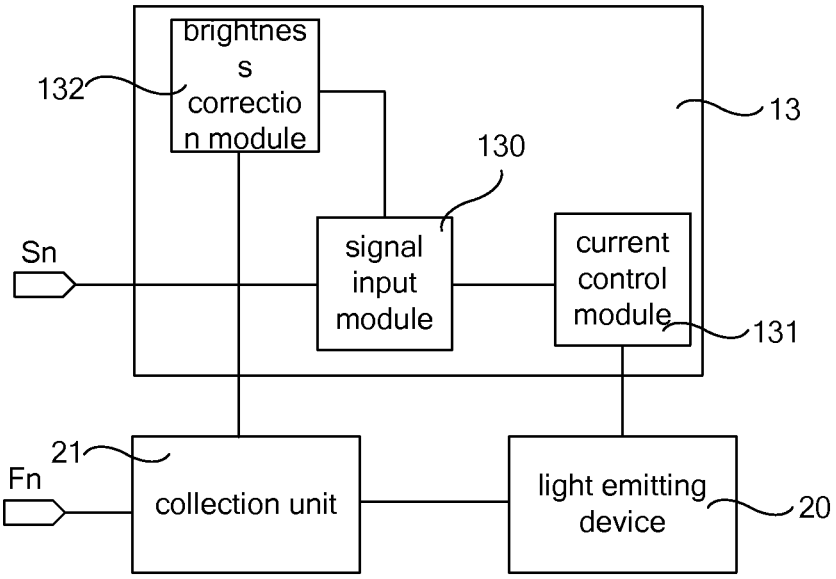
FIG. 3 is an exemplary view illustrating a structure of another display driving circuit provided by an embodiment of the present disclosure.

FIG. 3 is an exemplary view illustrating a structure of another display driving circuit provided by an embodiment of the present disclosure. Furthermore, the control unit 13 comprises a signal input module 130, a current control module 131 and a brightness correction module 132, as illustrated in FIG. 3.

The signal input module 130 is connected with a scan signal input terminal Sn, the brightness correction module 132 and the current control module 131 respectively, and is configured to transmit a signal input from the brightness correction module 132 to the current control module 131 according to a signal input from the scan signal input terminal Sn.

The current control module 131 is connected with the signal input module 130 and the light emitting device 20 respectively, and is configured to control the current flowing through the light emitting device 20 according to the signal input from the brightness correction module 132.

The brightness correction module 132 is connected with the collection unit 21, and is configured to perform a data processing on the collection result of the collection unit 21 according to the target brightness value D, in order to correct the brightness of the light emitting device 20.

Figure 4:
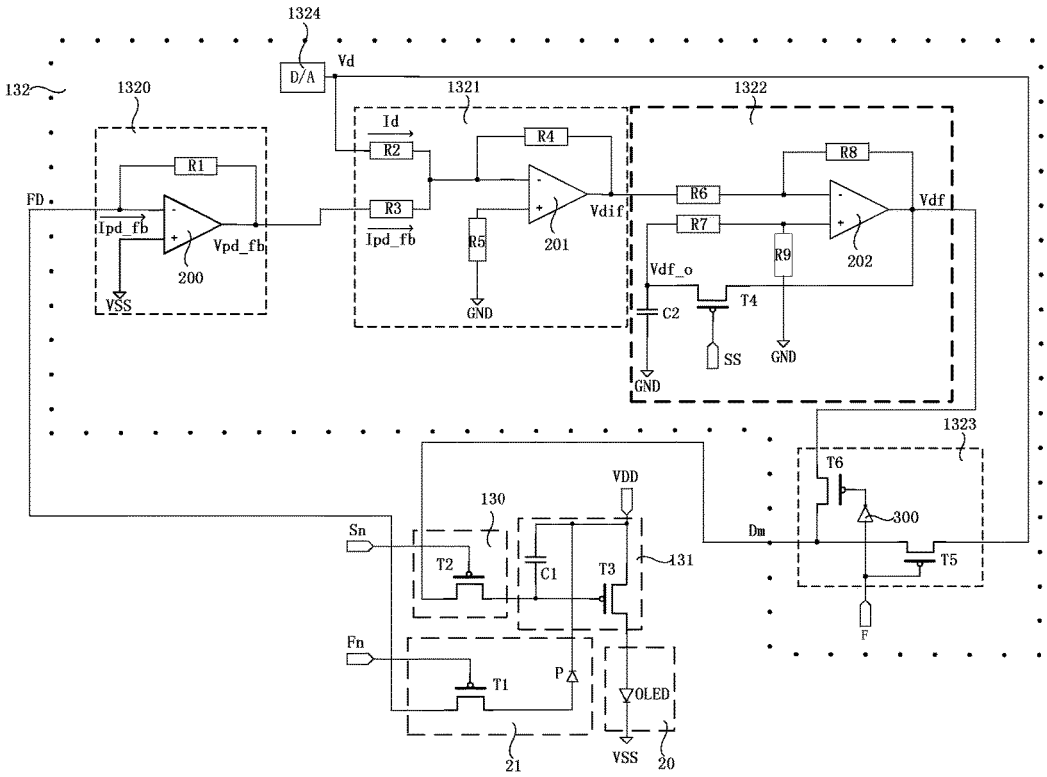
FIG. 4 is an exemplary view illustrating a structure of a further display driving circuit provided by an embodiment of the present disclosure.

FIG. 4 is an exemplary view illustrating a structure of a further display driving circuit provided by an embodiment of the present disclosure. For example, as shown in FIG. 4, the collection unit 21 may comprise a first transistor T1 and a photo-sensitive element P.

A gate of the first transistor T1 is connected with the collection signal input terminal Fn, a first electrode thereof is connected with an input terminal FD of the brightness correction module 132, a second electrode thereof is connected with an anode of the photo-sensitive element P, and a cathode of the photo-sensitive element P is connected with a second voltage VDD. Further, the photo-sensitive element P may comprise a photodiode or a phototransistor. The embodiments of the present disclosure are described by taking the photodiode as an example.

It should be noted that in the embodiments of the present disclosure, the first voltage VSS may be a low voltage or being connected to a ground terminal GND, and the second voltage VDD may refer to a high voltage.

The signal input module 130 may comprise a second transistor T2. The current control module 131 may comprise a third transistor T3 and the first capacitor C1.

A gate of the second transistor T2 is connected with the scan signal input terminal Sn, a first electrode thereof is connected with an output terminal Dm of the brightness correction module 132, and a second electrode thereof is connected with one terminal of the first capacitor C1.

A gate of the third transistor T3 is connected with the second electrode of the second transistor T2, a first electrode thereof is connected with the second voltage VDD, and a second electrode is connected with one terminal of the light emitting device 20 (the anode of the OLED device).

The other terminal of the first capacitor C1 is connected with the second voltage VDD.

As such, when the scan signal input terminal Sn turns on the second transistor T2, a signal input from the output terminal Dm of the brightness correction module 132 will be transferred to the gate of the third transistor T3 so as to control a turning-on/off of the third transistor T3, so that an object of controlling the OLED device to emit light is realized.

Furthermore, the above brightness correction module 132 may comprise an amplifying sub-module 1320, a deviation calculation sub-module 1321, a compensation sub-module 1322, a selection sub-module 1323 and a conversion sub-module 1324.

The conversion sub-module 1324 is connected with the deviation calculation sub-module 1321, and is configured to convert an analog signal A into a digital signal matched to the target brightness value D, that is, a target brightness voltage Vd corresponding to the target brightness value D.

The amplifying sub-module 1320 is connected with the collection unit 21 and the deviation calculation sub-module 1321 respectively, and is configured to amplify the data collected by the collection unit 21 so that an absolute value of an output voltage Vpd_fb from the amplifying sub-module 1320 is equal to the target brightness voltage Vd corresponding to the target brightness value D when a pre-light emitting brightness value Y of the light emitting device 20 is the target brightness value D. Wherein the pre-light emitting brightness value Y is a brightness value that light emitting device 20 intends to reach.

For example, the amplifying sub-module 1320 may comprise a first resistor R1 and a first comparator 200.

One terminal of the first resistor R is connected with an out-phase terminal of first comparator 200, and the other terminal thereof is connected with an output terminal of the first comparator 200.

An in-phase terminal of the first comparator 200 is connected with the first voltage VSS, the out-phase terminal thereof is connected with the collection unit 21, and the output terminal thereof is connected with the deviation calculation sub-module 1321.

The output voltage Vpd_fb of the amplifying sub-module 1320 is $Vpd_fb=-Ipd_fb\times R1$.

Wherein Ipd_fb is a current flowing though the OLED device and collected by the collection unit.

A resistance value of the first resistor R1 may be adjusted according to an experiment result(s) in order to ensure that, when the pre-light emitting brightness value Y of the OLED device is the target brightness value D, $|Vpd_fb|=Vd=Ipd_fb\times R1$, that is, $R1=Vd/Ipd_fb$. Wherein Vd is a target brightness voltage applied to the OLED device and corresponding to the target brightness value D.

However, because the resistance values of the OLED devices corresponding to different pixel units may be different, the currents Ipd_fb flowing through the OLED devices corresponding to the different pixel units may be different although the output voltage Vpd_fb from the amplifying sub-module 1320 is equal to the target brightness voltage Vd. Therefore it is required to collect the brightness of the OLED devices by the collection unit 21 so as to adjust the voltages applied to the OLED devices, such that the actual light emitting brightness values L of the OLED devices are the above target brightness value D. The adjustment process may be completed by the deviation calculation sub-module 1321 and the compensation sub-module 1322.

Furthermore, the deviation calculation sub-module 1321 is connected with the amplifying sub-module 1320, the conversion sub-module 1324 and the compensation sub-module 1322, and is configured to calculate a difference value between the absolute value of the output voltage Vpd_fb from the amplifying sub-module 1320 and the target brightness voltage Vd corresponding to the target brightness value D.

For example, the deviation calculation sub-module 1321 may comprise a second resistor R2, a third resistor R3, a fourth resistor R4, a fifth resistor R5 and a second comparator 201.

One terminal of the second resistor R2 is connected with the conversion sub-module 1324, and the other terminal thereof is connected with an out-phase terminal of the second comparator 201.

One terminal of the third resistor R3 is connected with the output terminal of the first comparator 200, and the other terminal thereof is connected with the out-phase terminal of the second comparator 201.

One terminal of the fourth resistor R4 is connected with the out-phase terminal of the second comparator 201, and the other terminal thereof is connected with an output terminal of the second comparator 201.

One terminal of the fifth resistor R5 is connected with an in-phase terminal of the second comparator 201, and the other terminal thereof is grounded to GND.

The output terminal of the second comparator 201 is connected with the compensation sub-module 1322.

As such, an output voltage Vdif from the deviation calculation sub-module 1321 is Vdif=−(Vd×R4/R2+Vpd_fb×R4/R3);

When R2=R3=R4, $$Vdif=-(Vd+Vpd_fb)=-Vd+Ipd_fb\times R1,$$

wherein R1=R2=R3=R4.

Thus, the difference value between the absolute value of the output voltage Vpd_fb from the amplifying sub-module 1320 and the target brightness voltage Vd corresponding to the target brightness value D may be calculated, namely, the output voltage Vdif of the deviation calculation sub-module 1321.

Furthermore, the compensation sub-module 1322 is connected with the deviation calculation sub-module 1321 and the selection sub-module 1323 respectively, and is configured to compensate an output result of the brightness correction module 132 based on the output voltage Vdif of the deviation calculation sub-module 1321.

For example, the compensation sub-module 1322 may comprise a second capacitor C2, a sixth resistor R6, a seventh resistor R7, an eighth resistor R8, a ninth resistor R9, a third comparator 202 and a fourth transistor T4.

One terminal of the sixth resistor R6 is connected with the output terminal of the second comparator 201, and the other terminal thereof is connected with an out-phase terminal of the third comparator 202.

One terminal of the seventh resistor R7 is connected with one terminal of the second capacitor C2, and the other terminal thereof is connected with an in-phase terminal of the third comparator 202.

One terminal of the eighth resistor R8 is connected with the out-phase terminal of the third comparator 202, and the other terminal thereof is connected with an output terminal of the third comparator 202.

One terminal of the ninth resistor R9 is connected with the in-phase terminal of the third comparator 202, and the other terminal thereof is grounded to GND.

A gate of the fourth transistor T4 is connected with a first switch control signal SS, a first electrode thereof is connected with one terminal of the second capacitor C2, and a second electrode thereof is connected with the output terminal of the third comparator 202.

The other terminal of the second capacitor C2 is grounded to GND.

The output terminal of the third comparator 202 is connected with the selection sub-module 1323.

When R6=R7=R8=R9, $$Vdf=Vdf_o-Vdif=Vdf_o+Vd-Ipd_fb\times R1,$$

and Vd=Ipd_fb×R1 when the actual brightness value L of the OLED device reaches the target brightness value D, then, Vdf=Vdf_o; wherein Vdf_o is a sampled voltage obtained by sampling the output voltage Vdf of the compensation sub-module 1322 via the fourth transistor T4, in order to ensure a stability of the output voltage Vdf of the compensation sub-module 1322.

It should be noted that the first switch control signal SS is an alternating current signal and may control a turning on/off of the fourth transistor T4 as required. For example, in order to avoid an over-compensation, the fourth transistor T4 may be turned on periodically by the first switch control signal SS to sample the output voltage Vdf of the compensation sub-module 1322 periodically.

Furthermore, the selection sub-module 1323 is connected with the conversion sub-module 1324, the compensation sub-module 1322 and the signal input module 130, and is configured to select a signal to be input to the module 130 from the output terminal Dm of the brightness correction module 132.

For example, the selection sub-module 1323 may comprise a fifth transistor T5, a sixth transistor T6 and an inverter 300.

A gate of the fifth transistor T5 is connected with a second switch control signal F, a first electrode thereof is connected with the conversion sub-module 1324, and a second electrode thereof is connected with the first electrode of the second transistor T2.

A gate of the sixth transistor T6 is connected with an output terminal of the inverter 300, a first electrode thereof is connected with the first electrode of the second transistor T2, and a second electrode thereof is connected with the output terminal of the third comparator 202.

An input terminal of the inverter 300 is connected with the second switch control signal F. Wherein the second switch control signal F controls a turning on/off of the fifth transistor T5 and the sixth transistor T6. Under an effect of the inverter 300, the sixth transistor T6 is turned off when the fifth transistor T5 is turned on, and the fifth transistor T5 is turned off when the sixth transistor T6 is turned on. As such, the selection sub-module 1323 may select the signal to be input to the module 130 through the output terminal Dm of brightness correction module 132 between the target brightness voltage Vd output from the conversion sub-module 1324 and the output voltage Vdf of the compensation sub-module 1322. For example, when the collection unit 21 is not turned on, no signal is input to the collection signal input terminal Fn and therefore the collection unit 21 can not collect the current flowing through the OLED device, such that the compensation sub-module 1322 outputs no voltage. In this situation, the sixth transistor T6 is turned off, the fifth transistor T5 is turned on, and the signal input to the module 130 through the output terminal Dm of the brightness correction module 132 is the target brightness voltage Vd output from the conversion sub-module 1324. Further, when the collection unit 21 is turned on, the fifth transistor T5 is turned off, the sixth transistor T6 is turned on, therefore the signal input to the module 130 through the output terminal Dm of the brightness correction module 132 is the output voltage Vdf of the compensation sub-module 1322.

Further, the first to sixth transistors T1~T6 may be P-type transistors.

Alternatively, the first to sixth transistors T1~T6 may be N-type transistors.

Alternatively, the first to three transistors T1~T3 are the P-type transistors; the fourth to sixth transistors T4~T6 may be the N-type transistors.

Alternatively, the first to three transistors T1~T3 are the N-type transistors; the fourth to sixth transistors T4~T6 may be the P-type transistors.

It should be noted that the first to sixth transistors T1~T6 may be enhanced TFTs or depletion TFTs. The embodiments of the present disclosure are explained by taking the first to sixth transistors T1~T6 being the P-type enhanced TFTs as an example. Wherein the first electrodes of the first to sixth transistors T1~T6 are all sources while the second electrodes thereof are all drains.

Figure 5:
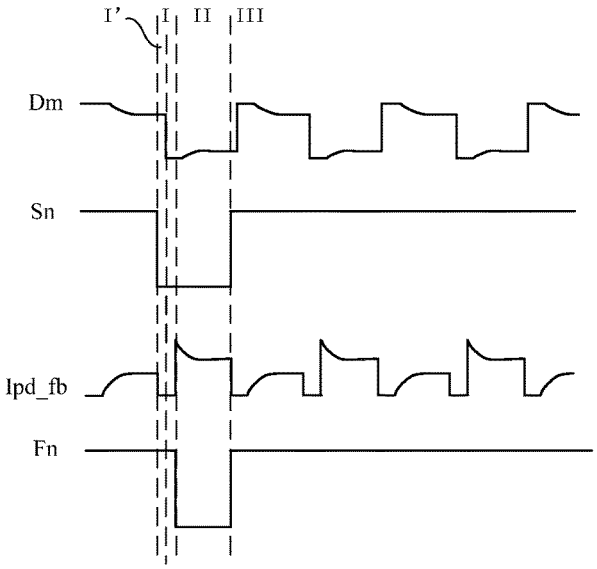
FIG. 5 is an operation time sequence diagram of a display driving circuit provided by an embodiment of the present disclosure.
Figure 6:
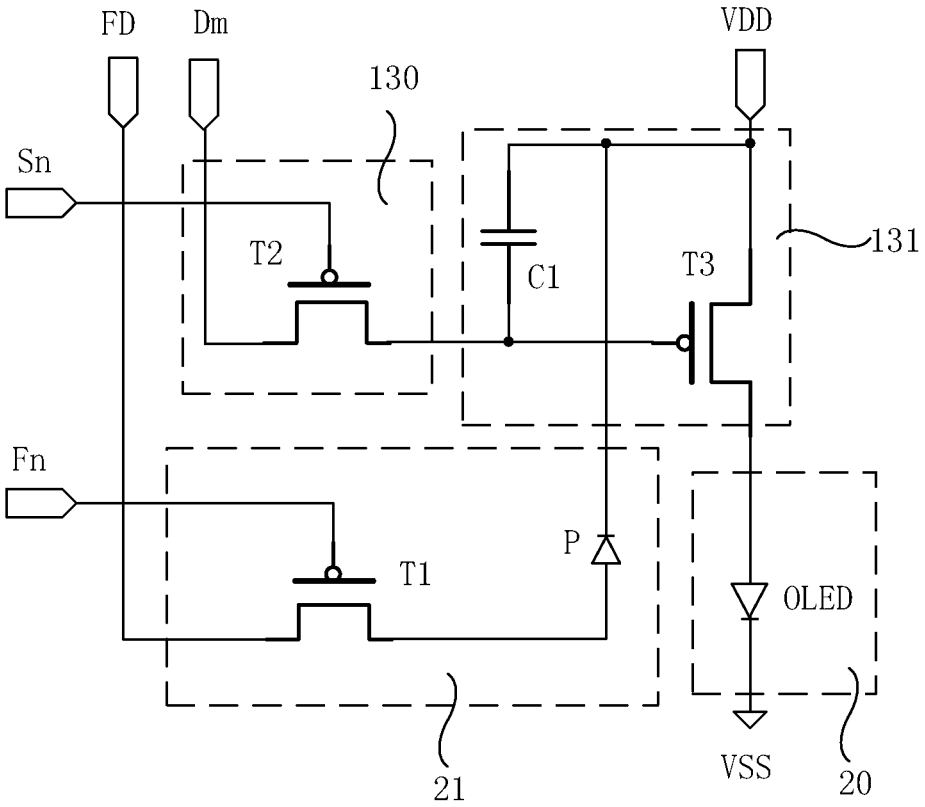
FIG. 6 is an exemplary view illustrating a structure of a still further display driving circuit provided by an embodiment of the present disclosure.

FIG. 5 is an operation time sequence diagram of a display driving circuit provided by an embodiment of the present disclosure, and FIG. 6 is an exemplary view illustrating a structure of a still further display driving circuit provided by an embodiment of the present disclosure. Thereafter, an operation process for the display driving circuit shown in FIG. 6 would be described in connection with FIG. 5. In FIG. 6, the brightness correction module 132 in FIG. 4 is simplified as a feedback channel FD (that is, the input terminal of the brightness correction module 132) connected to the first electrode of the first transistor T1 in the collection unit 21, and is configured to input the current Ipd_fb flowing through the OLED device, collected by the collection unit 21, to the brightness correction module 132; also, the brightness correction module 132 in FIG. 4 is simplified as a data channel Dm (that is, the output terminal of the brightness correction module 132) connected to the first electrode of the second transistor T2 in the signal input module 130, and is configured to input the signal.

FIG. 5 illustrates the operation time sequence diagram of the above display driving circuit, and the operation process may be divided into three phases: a charging phase, a brightness correction phase and a brightness holding phase.

The first phase is the charging phase I. In the charging phase I, the scan signal input terminal Sn inputs a low voltage level, the second transistor T2 is turned on. The collection signal input terminal Fn inputs a high voltage level, the first transistor T1 is turned off, so the collection unit 21 is in a non-operation state and no current flows into the brightness correction module 132 through the feedback channel FD. In this situation, the second switch control signal F inputs the low voltage level, the fifth transistor T5 in the selection sub-module 1323 is turned on, so that the brightness correction module 132 inputs the target brightness voltage Vd output from the conversion sub-module 1324 to the gate of the third transistor T3 via the data channel Dm, then the OLED device starts to emit light.

It should be note that the above charging phase I may also comprise a charging preparation phase I'. During the charging preparation phase I', the scan signal input terminal Sn inputs the low voltage level and the second transistor T2 is turned on, the collection signal input terminal Fn inputs the high voltage level, the first transistor T1 is turned off, therefore the collection unit 21 is in the non-operation state, no current is input to the brightness correction module 132 through the feedback channel FD. In this situation, the brightness correction module 132 inputs a voltage signal of a previous row to the gate of the third transistor T3 via the data channel Dm.

The second phase is the brightness correction phase II. In the brightness correction phase II, the collection signal input terminal Fn inputs the low voltage level, the first transistor T1 is turned on, the collection unit 21 starts to operate and collect the brightness of the OLED device, and feed the current Ipf_fb flowing through the OLED device to the brightness correction module 132, then the voltage applied to the OLED device is compensated through the amplifying sub-module 1320, the deviation calculation sub-module 1321 and the compensation sub-module 1322 in the brightness correction module 132 and the brightness value of the OLED device is adjusted until the actual brightness value L is equal to the target brightness value D. Further, the second switch control signal F inputs the high voltage level, the sixth transistor T6 in the selection sub-module 1323 is turned on; also, the scan signal input terminal Sn inputs the low voltage level, the second transistor T2 is turned on, the brightness correction module 132 stores the output voltage Vdf of the compensation sub-module 1322 to the gate of the third transistor T3 via the data channel Dm, the third transistor T3 is turned on, and the light emitting brightness of the OLED device varies with the signal input from the selection sub-module 1323 via the data channel Dm.

The third phase is the brightness holding phase III. In the brightness holding phase III, the scan signal input terminal Sn inputs the high voltage level, the second transistor T2 is turned off, the collection signal input terminal Fn inputs the high voltage level, the first transistor T1 is turned off, therefore the collection unit 21 is in the non-operation state and no current is input to the brightness correction module 132 through the feedback channel FD. The signal input by the selection sub-module 1323 through the data channel Dm is stored in the first capacitor C1 and acts on the gate of the third transistor T3. In this situation, the third transistor T3 remains to be turned on and the light emitting brightness of the OLED device will not vary any more until a first phase for the next frame starts.

Thereafter, the first to the third phases are repeated.

It should be noted that external control signals for the pixel circuit would be different if different types of transistors are used. For example, when the display driving circuit composed of the first to sixth transistors T1~T6 being the N-type transistors is driven to operate, the time sequences for the signal input by the selection sub-module 1323 via the data channel Dm and the signals input from the scan signal input terminal Sn and the collection signal input terminal Fn would be inversed to those for corresponding signals shown in FIG. 5 (namely, a phase difference between them is 180°). The time sequences for other display driving circuits composed of further different types of transistors as they operate would not be repeated herein.

Figure 7A:
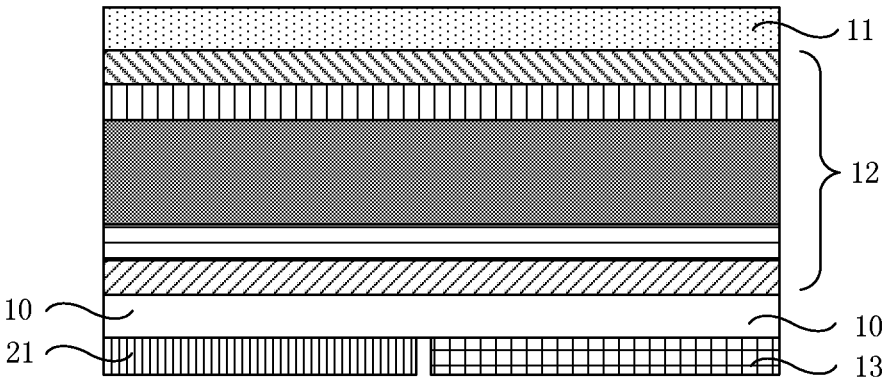
FIG. 7*a* is an exemplary view illustrating a structure of a display apparatus provided by an embodiment of the present disclosure.

FIG. 7*a* is an exemplary view illustrating a structure of a display apparatus provided by an embodiment of the present disclosure. As illustrated in FIG. 7*a*, the display apparatus comprises an anode 10, a cathode 11 and an organic material functional layer 12 located between the anode 10 and the cathode 11, and the display apparatus further comprises any one of the display driving circuits 01 described above.

The control unit 13 and the collection unit 21 of the display driving circuit 01 are disposed on a surface of the anode at a side far away the organic material functional layer 12.

At least the anode 10 corresponding to a position at which the collection unit 21 is disposed is made up of a transparent conductive material.

It should be noted that the transparent conductive material may comprise Indium Tin Oxide or Indium Zinc Oxide.

The embodiments of the present disclosure provide a display apparatus which comprises the anode, the cathode and the organic material functional layer located between the anode and the cathode, and further comprises any one of the display driving circuits described above. As such, the display driving circuit can collect the light emitting brightness of the light emitting device in the display apparatus and adjust the brightness of the light emitting device in real-time according to the above collection result, thus the actual light emitting brightness of the light emitting device can reach the target brightness value finally, which can ensure the brightness of light emitted from respective pixel unit to be uniform and enhance the uniformity in the brightness of the display apparatus.

Figure 7B:
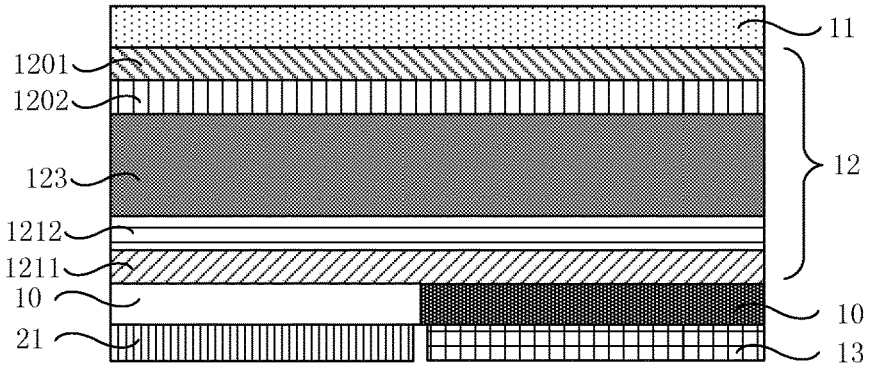
FIG. 7*b* is an exemplary view illustrating a structure of another display apparatus provided by an embodiment of the present disclosure.

FIG. 7*b* is an exemplary view illustrating a structure of another display apparatus provided by an embodiment of the present disclosure. Further, as illustrated in FIG. 7*b*, in a case that the anode corresponding to the position at which the collection unit 21 is disposed is made up of the transparent conductive material, the anode corresponding to a position at which the control unit 13 is made up of a metal material. Because a conductibility of the metal material is higher than that of the transparent conductive material, therefore, with such structure, a conductive performance at the anode of the display apparatus and corresponding speed of the control unit 13 are increased while the collection unit 21 is ensured to conduct photosensitive collection on the display apparatus.

Furthermore, the organic material functional layer 12 may comprise an organic light emitting material layer 123.

As illustrated in FIG. 7*b*, the organic material functional layer 12 may further comprise:

an electron injection layer 1201 and an electron transferring layer 1202 located sequentially on the surface of the organic light emitting material layer 123 at a side close to the cathode 11; and a hole injection layer 1211 and a hole transferring layer 1212 located sequentially on the surface of the organic light emitting material layer 123 at a side close to the anode 10.

Figure 7C:
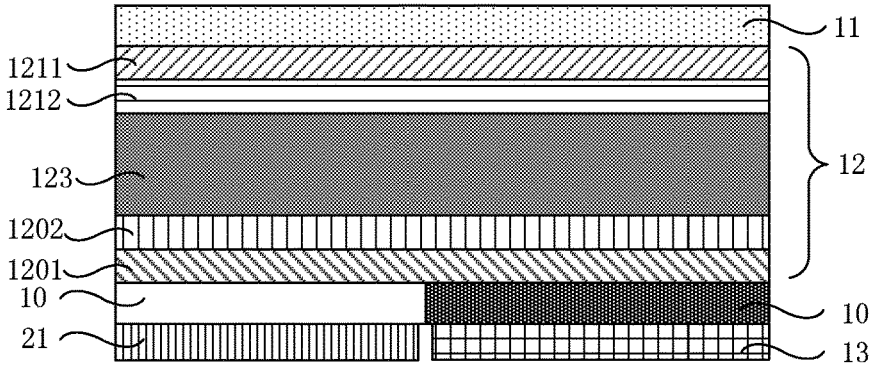
FIG. 7*c* is an exemplary view illustrating a structure of a further display apparatus provided by an embodiment of the present disclosure.

FIG. 7*c* is an exemplary view illustrating a structure of a further display apparatus provided by an embodiment of the present disclosure. As illustrated in FIG. 7*c*, the organic material functional layer 12 may further comprise:

a hole injection layer 1211 and a hole transferring layer 1212 located sequentially on the surface of the organic light emitting material layer 123 at a side close to the cathode 11; and an electron injection layer 1201 and an electron transferring layer 1202 located sequentially on the surface of the organic light emitting material layer 123 at a side close to the anode 110.

Figure 8:
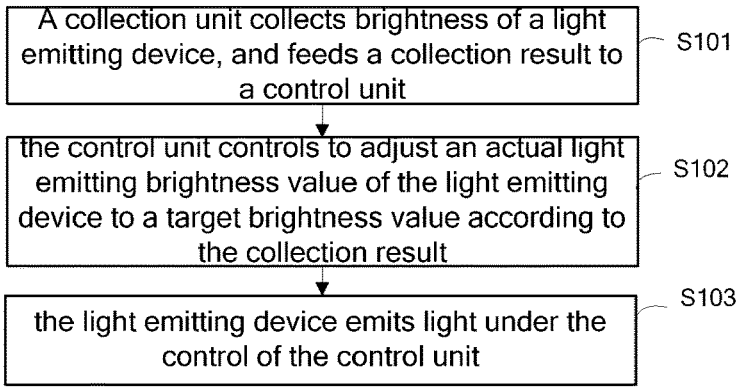
FIG. 8 is a flowchart of a driving method for a display driving circuit provided by an embodiment of the present disclosure.

The embodiments of the present disclosure provide a driving method of a display driving circuit, and FIG. 8 is a flowchart of the driving method. As illustrated in FIG. 8, the method may comprise the following steps.

S101, the collection unit 21 collects the brightness of the light emitting device 20, and feeds a collection result to the control unit 13;

S102, the control unit 13 controls to adjust the actual light emitting brightness value L of the light emitting device 20 to the target brightness value D according to the collection result; and S103, the light emitting device 20 emits light under the control of the control unit 13.

The embodiments of the present disclosure provide a driving method of the display driving circuit, comprising: at first, the collection unit collects the brightness of the light emitting device, and feeds a collection result to the control unit; next, the control unit controls to adjust the actual light emitting brightness value of the light emitting device to the target brightness value according to the collection result; and at last, the light emitting device emits light under the control of the control unit. As such, the display driving circuit can collect the light emitting brightness of the light emitting device and adjust the brightness of the light emitting device in real-time according to the above collection result, thus the actual light emitting brightness of the light emitting device can reach the target brightness value finally, which can ensure the brightness of light emitted from respective pixel unit to be uniform.

Furthermore, in a case that the collection unit 21 comprises the first transistor T1, the signal input module 130 of the control unit 13 comprises the second transistor T2 and the current control module 131 of the control unit 13 comprises the third transistor T3, the first to third transistors T1~T3 may all be the P-type transistors;

alternatively, the first to third transistors T1~T3 may all be the N-type transistors.

Furthermore, in the case that the first to third transistors T1~T3 are all the P-type transistors, a time sequence for the control signals of the driving method of the display driving circuit is as follows.

In the first phase, namely the charging phase I, the scan signal input terminal Sn inputs the low voltage level and the collection signal input terminal Fn inputs the high voltage level.

For example, the scan signal input terminal Sn inputs a low voltage level, the second transistor T2 is turned on. The collection signal input terminal Fn inputs a high voltage level, the first transistor T1 is turned off, so the collection unit 21 is in a non-operation state and no current flows into the brightness correction module 132 through the feedback channel FD. In this situation, the second switch control signal F inputs the low voltage level, the fifth transistor T5 in the selection sub-module 1323 is turned on, so that the brightness correction module 132 inputs the target brightness voltage Vd output from the conversion sub-module 1324 to the gate of the third transistor T3 via the data channel Dm, then the OLED device starts to emit light.

It should be note that the above charging phase I may also comprise a charging preparation phase I'. During the charging preparation phase I', the scan signal input terminal Sn inputs the low voltage level and the second transistor T2 is turned on, the collection signal input terminal Fn inputs the high voltage level, the first transistor T1 is turned off, therefore the collection unit 21 is in the non-operation state, no current is input to the brightness correction module 132 through the feedback channel FD. In this situation, the brightness correction module 132 inputs a voltage signal of a previous row to the gate of the third transistor T3 via the data channel Dm.

In the second phase, namely the brightness correction phase II, the scan signal input terminal Sn inputs the low voltage level and the collection signal input terminal Fn inputs the low voltage level.

For example, the collection signal input terminal Fn inputs the low voltage level, the first transistor T1 is turned on, the collection unit 21 starts to operate and collect the brightness of the OLED device, and feed the current Ipf_fb flowing through the OLED device to the brightness correction module 132, then the voltage applied to the OLED device is compensated through the amplifying sub-module 1320, the deviation calculation sub-module 1321 and the compensation sub-module 1322 in the brightness correction module 132 and the brightness value of the OLED device is adjusted until the actual brightness value L is equal to the target brightness value D. Further, the second switch control signal F inputs the high voltage level, the sixth transistor T6 in the selection sub-module 1323 is turned on; also, the scan signal input terminal Sn inputs the low voltage level, the second transistor T2 is turned on, the brightness correction module 132 stores the output voltage Vdf of the compensation sub-module 1322 to the gate of the third transistor T3 via the data channel Dm, the third transistor T3 is turned on, and the light emitting brightness of the OLED device varies with the signal input from the selection sub-module 1323 via the data channel Dm.

In the third phase, namely the brightness holding phase III, the scan signal input terminal Sn inputs the high voltage level and the collection signal input terminal Fn inputs the high voltage level.

For example, the scan signal input terminal Sn inputs the high voltage level, the second transistor T2 is turned off, the collection signal input terminal Fn inputs the high voltage level, the first transistor T1 is turned off, therefore the collection unit 21 is in the non-operation state and no current is input to the brightness correction module 132 through the feedback channel FD. The signal input by the selection sub-module 1323 through the data channel Dm is stored in the first capacitor C1 and acts on the gate of the third transistor T3, so that the third transistor T3 remains to be turned on in this situation and the light emitting brightness of the OLED device will not vary any more until a first phase for the next frame starts.

Thereafter, the first to the third phases are repeated.

It should be noted that external control signals for the pixel circuit would be different if different types of transistors are used. For example, when the display driving circuit composed of the first to sixth transistors T1~T6 being the N-type transistors is driven to operate, the time sequences for the signal input by the selection sub-module 1323 via the data channel Dm and the signals input from the scan signal input terminal Sn and the collection signal input terminal Fn would be inversed to those for the above corresponding signals (namely, a phase difference between them is 180°). The time sequences for other display driving circuits composed of further different types of transistors as they operate will not be repeated herein.

Those ordinary skilled in the art can understand that all or part of steps implementing the above method embodiments may be completed by instructing relevant hardware through programs, these programs may be stored in a computer readable storage medium, the steps included in the above method embodiments will be executed when the programs are executed; the aforesaid storage medium includes various media capable of storing program codes such as a ROM, a RAM, a magnetic disk, or an optical disk.

The above descriptions only illustrate the specific embodiments of the present invention, and the protection scope of the present invention is not limited to this. modifications or replacements that are easily conceivable for those skilled in the art within the technique range disclosed in the present disclosure should all fall into the protection scope of the present disclosure. Therefore, the protection scope of the present disclosure should be based on what is claimed in the claims.

This application claims priority to a Chinese Patent Application No. 201410342889.1, filed on Jul. 18, 2014, in the China's State Intellectual Property Office, the disclosure of which is incorporated by reference herein as a whole.

What is claimed is:

1. A display driving circuit comprising a control unit, a light emitting device and a collection unit; wherein the collection unit is connected with one terminal of the light emitting device, the control unit and a collection signal input terminal respectively, and is configured to collect brightness of the light emitting device according to a signal input from the collection signal input terminal and feed a collection result to the control unit;

the control unit is connected with the one terminal of the light emitting device and the collection unit respectively, and is configured to adjust an actual light emitting brightness value of the light emitting device to a target brightness value according to the collection result;

the other terminal of the light emitting device is connected with a first voltage, and the light emitting device is configured to emit light under the control of the control unit, wherein the control unit comprises a signal input module, a current control module and a brightness correction module;

the signal input module is connected with a scan signal input terminal, the brightness correction module and the current control module respectively, and is configured to transmit a signal input from the brightness correction module to the current control module according to a signal input from the scan signal input terminal;

the current control module is connected with the signal input module and the light emitting device respectively, and is configured to control the current flowing through the light emitting device according to the signal input from the brightness correction module; and the brightness correction module is connected with the collection unit, and is configured to perform a data processing on the collection result of the collection unit according to the target brightness value, in order to correct the brightness of the light emitting device.

2. The display driving circuit of claim 1, wherein the collection unit comprises a first transistor and a photo-sensitive element;

a gate of the first transistor is connected with the collection signal input terminal, a first electrode thereof is connected with an input terminal of the brightness correction module, a second electrode thereof is connected with an anode of the photo-sensitive element, and a cathode of the photo-sensitive element is connected with a second voltage.

3. The display driving circuit of claim 2, wherein, the signal input module comprises a second transistor, the current control module comprises a third transistor and the first capacitor;

wherein, a gate of the second transistor is connected with the scan signal input terminal, a first electrode thereof is connected with an output terminal of the brightness correction module, and a second electrode thereof is connected with one terminal of the first capacitor;

a gate of the third transistor is connected with the second electrode of the second transistor, a first electrode thereof is connected with the second voltage, and a second electrode is connected with one terminal of the light emitting device; and the other terminal of the first capacitor is connected with the second voltage.

4. The display driving circuit of claim 1, wherein the brightness correction module comprises an amplifying sub-module; a deviation calculation sub-module, a compensation sub-module; a selection sub-module and a conversion sub-module, the amplifying sub-module is connected with the collection unit and the deviation calculation sub-module respectively; and is configured to amplify the data collected by the collection unit so that an absolute value of an output voltage from the amplifying sub-module is equal to the target brightness voltage corresponding to the target brightness value when a pre-light emitting brightness value of the light emitting device is the target brightness value;

the conversion sub-module is connected with the deviation calculation sub-module, and is configured to convert an analog signal into a digital signal matched to the target brightness value;

the deviation calculation sub-module is connected with the amplifying sub-module, the conversion sub-module and the compensation sub-module respectively, and is configured to calculate a difference value between the absolute value of the output voltage from the amplifying sub-module and the target brightness voltage corresponding to the target brightness value;

the compensation sub-module is connected with the deviation calculation sub-module and the selection sub-module respectively, and is configured to compensate an output result of the brightness correction module based on the output voltage of the deviation calculation sub-module; and the selection sub-module is connected with the conversion sub-module, the compensation sub-module and the signal input module respectively, and is configured to select a signal to be input to the signal input module.

5. The display driving circuit of claim 4, wherein the amplifying sub-module comprises a first resistor and a first comparator;

one terminal of the first resistor is connected with an out-phase terminal of first comparator, and the other terminal thereof is connected with an output terminal of the first comparator; and an in-phase terminal of the first comparator is connected with the first voltage, the out-phase terminal thereof is connected with the collection unit, and the output terminal thereof is connected with the deviation calculation sub-module.

6. The display driving circuit of claim 5, wherein the deviation calculation sub-module comprises a second resistor, a third resistor, a fourth resistor, a fifth resistor and a second comparator;

one terminal of the second resistor is connected with the conversion sub-module, and the other terminal thereof is connected with an out-phase terminal of the second comparator;

one terminal of the third resistor is connected with the output terminal of the first comparator, and the other terminal thereof is connected with the out-phase terminal of the second comparator;

one terminal of the fourth resistor is connected with the out-phase terminal of the second comparator, and the other terminal thereof is connected with an output terminal of the second comparator;

one terminal of the fifth resistor is connected with an in-phase terminal of the second comparator, and the other terminal thereof is grounded; and the output terminal of the second comparator is connected with the compensation sub-module.

7. The display driving circuit of claim 6, wherein the compensation sub-module comprises a second capacitor, a sixth resistor, a seventh resistor, an eighth resistor, a ninth resistor, a third comparator and a fourth transistor;

one terminal of the sixth resistor is connected with the output terminal of the second comparator, and the other terminal thereof is connected with an out-phase terminal of the third comparator;

one terminal of the seventh resistor is connected with one terminal of the second capacitor, and the other terminal thereof is connected with an in-phase terminal of the third comparator;

one terminal of the eighth resistor is connected with the out-phase terminalof the third comparator, and the other terminal thereof is connected with an output terminal of the third comparator;

one terminal of the ninth resistor is connected with the in-phase terminal of the third comparator, and the other terminal thereof is grounded;

a gate of the fourth transistor is connected with a first switch control signal, a first electrode thereof is connected with one terminal of the second capacitor, and a second electrode thereof is connected with the output terminal of the third comparator;

the other terminal of the second capacitor is grounded; and the output terminal of the third comparator is connected with the selection sub-module.

8. The display driving circuit of claim 7, wherein the first switch control signal is an alternating signal and controls a turning on/off of the fourth transistor as required.

9. The display driving circuit of claim 6, wherein the selection sub-module comprises a fifth transistor, a sixth transistor and an inverter;

a gate of the fifth transistor is connected with a second switch control signal, a first electrode thereof is connected with the conversion sub-module, and a second electrode thereof is connected with the first electrode of the second transistor;

a gate of the sixth transistor is connected with an output terminal of the inverter, a first electrode thereof is connected with the first electrode of the second transistor, and a second electrode thereof is connected with the output terminal of the third comparator; and an input terminal of the inverter is connected with the second switch control signal.

10. The display driving circuit of claim 9, wherein the first transistor, the second transistor, the third transistor, the fourth transistor, the fifth transistor and the sixth transistor are P-type transistors.

11. The display driving circuit of claim 9, wherein the first transistor, the second transistor, the third transistor, the fourth transistor, the fifth transistor and the sixth transistor are N-type transistors.

12. A display apparatus comprising an anode, a cathode and an organic material functional layer located between the anode and the cathode, and further comprising the display driving circuit of claim 1; wherein the control unit and the collection unit of the display driving circuit are disposed on a surface of the anode at a side far away the organic material functional layer; and at least the anode corresponding to a position at which the collection unit is disposed is made up of a transparent conductive material.

13. The display apparatus of claim 12, wherein in a case that the anode corresponding to the position at which the collection unit is disposed is made up of the transparent conductive material, the anode corresponding to a position at which the control unit is made up of a metal material.

14. The display apparatus of claim 12, wherein the organic material functional layer comprises an organic light emitting material layer.

15. The display apparatus of claim 14, wherein the organic material functional layer further comprises:

an electron injection layer and an electron transferring layer located sequentially on the surface of the organic light emitting material layer at a side close to the cathode; and a hole injection layer and a hole transferring layer located sequentially on the surface of the organic light emitting material layer at a side close to the anode.

16. The display apparatus of claim 14, wherein the organic material functional layer further comprises:

a hole injection layer and a hole transferring layer located sequentially on the surface of the organic light emitting material layer at a side close to the cathode; and an electron injection layer and an electron transferring layer located sequentially on the surface of the organic light emitting material layer at a side close to the anode.

17. A driving method of a display driving circuit, comprising:

collecting, by a collection unit, brightness of a light emitting device, and feeding a collection result to a control unit;

controlling, by the control unit, to adjust an actual light emitting brightness value of the light emitting device to a target brightness value according to the collection result; and emitting light, by the light emitting device, under the control of the control unit, wherein the control unit comprises a signal input module, a current control module and a brightness correction module, the signal input module is connected with a scan signal input terminal, the brightness correction module and the current control module respectively, the current control module is connected with the signal input module and the light emitting device respectively, the brightness correction module is connected with the collection unit, the method further comprising:

transmitting, by the signal input module, a signal input from the brightness correction module to the current control module according to a signal input from the scan signal input terminal;

controlling, by the current control module, the current flowing through the light emitting device according to the signal input from the brightness correction module; and performing, by the brightness correction module, a data processing on the collection result of the collection unit according to the target brightness value, in order to correct the brightness of the light emitting device.

18. The driving method of the display driving circuit of claim 17, wherein in a case that the collection unit comprises a first transistor, a signal input module of the control unit comprises a second transistor and a current control module of the control unit comprises a third transistor, the first to third transistors are all P-type transistors.

19. The driving method of the display driving circuit of claim 17, wherein in a case that the collection unit comprises a first transistor, a signal input module of the control unit comprises a second transistor and a current control module of the control unit comprises a third transistor, the first to third transistors are all N-type transistors.

* * * * *